United States Patent [19]

Newberry et al.

[11] Patent Number: 4,906,177

[45] Date of Patent: Mar. 6, 1990

[54] ELECTRONIC CONTROLLER FOR FLUID FUEL BURNER

[75] Inventors: Richard D. Newberry, Hadley; Roger W. Williams, Jr., Springfield, both of Mass.

[73] Assignee: R. E. Phelon Company, Inc., East Longmeadow, Mass.

[21] Appl. No.: 293,883

[22] Filed: Jan. 3, 1989

[51] Int. Cl.[4] ..... F23Q 9/08

[52] U.S. Cl. ..... 431/46; 431/71

[58] Field of Search ..... 431/45–47, 431/69–74

[56] References Cited

U.S. PATENT DOCUMENTS

| | | | |
|---|---|---|---|
| 3,449,055 | 6/1969 | Blackett | 431/46 |
| 3,644,074 | 2/1972 | Cade | 431/46 |
| 4,359,315 | 11/1982 | Matthews | 431/46 |
| 4,789,329 | 12/1988 | Bohan et al. | 431/46 |

*Primary Examiner*—Carroll B. Dority

*Attorney, Agent, or Firm*—Chapin, Neal & Dempsey

[57] ABSTRACT

Electronic control system for an oil burner has a primary direct current power source controlled by a thermostat and a secondary direct current power source independent of the thermostat. A first relay is in circuit with the oil burner motor to energize the same and a second relay is in series with the first and with an alternating voltage source for energizing the ignitor of the furnace. An electronic circuit controls the first relay switch and includes a pair of silicon controlled rectifiers (SCR's) connected in series for energizing the first relay. A second electronic circuit includes a pair of interconnected NPN transistors for controlling the operation of the second relay switch. The first NPN transistor is conductive when the second relay switch is energized and the second NPN transistor is connected to the first to turn "OFF" the same in response to flame being sensed in the furnace. A flame sensing element in the furnace is associated with a control relay for controlling a pair of relay switches, one of which is in series with the SCR's and the other is adapted to energize a redundant pair of time-delay circuits. Each time-delay circuit includes a capacitor and a programmable unijunction transistor (PUT) programmed to breakover at a voltage which is a function of a first predetermined time for charging a capacitor and a resistance in the cathode circuit of each PUT which provides for a second predetermined time for the discharge of the capacitor voltage to hold the second relay "OPEN" by conduction through the second NPN transistor. Another electronic circuit includes an NPN transistor and PNP transistor connected to energize the first relay switch.

7 Claims, 1 Drawing Sheet

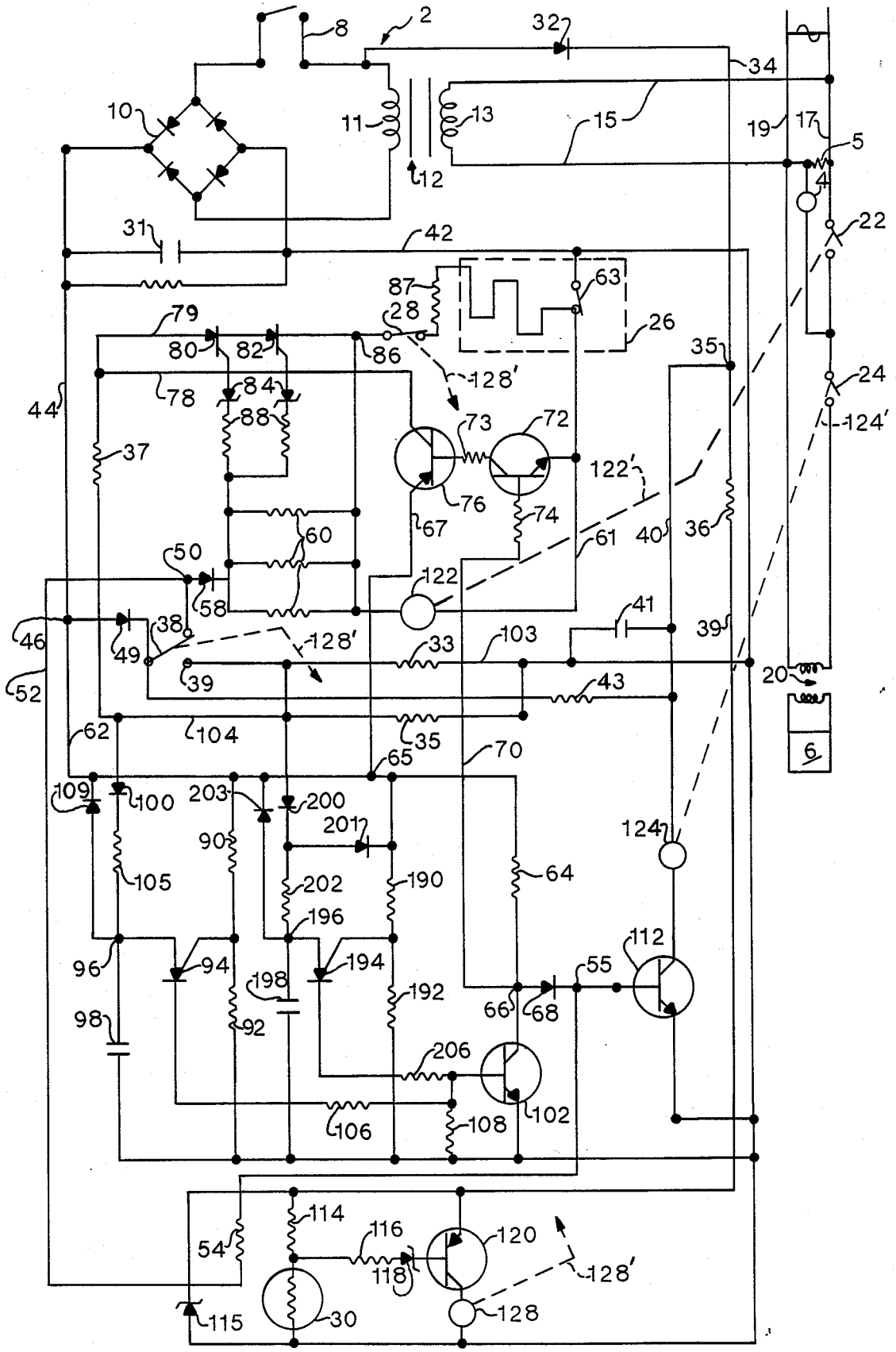
2
8
32
34
10
11
13
15
19
17
5
4
12
22
31
42
87
63
28
26
79
80
82
86
128'
35
24
124'
44
78
84
88
73
72
122'
37
76
74
67
60
61
40
36
50
58
122
41
46
38
49
128'
33
103
39
52
39
43
20
62
104
35
70
6
65
109
100
203
200
201
124
90
105
202
190
64
196
112
96
94
194
55
198
192
66
68
98
92
206
102
106
108
114
116
120
54
118
128'
115
30
128

ELECTRONIC CONTROLLER FOR FLUID FUEL BURNER

BACKGROUND OF THE INVENTION

This invention relates to an improved electronic control system for an oil burner motor and ignitor, but in some aspects is also applicable to a gas-fired furnace.

In particular, this invention utilizes an electronic circuit which comprises a silicon controlled rectifier for energizing a control relay to energize the oil burner motor and a combination of a capacitance/resistance network and programmable unijunction transistor (PUT) for controlling the dual time delayed operation of a second control relay to energize selectively the ignitor of the burner.

Insofar as applicant is aware, there is no prior or existing electronic system which utilizes solid state components to control an oil burner motor and ignitor in the manner of this invention. In most cases, such systems rely primarily on electromagnetic components, such as solenoids and timing mechanisms.

It is the principal object of this invention to provide an improved electronic control system for an oil burner and ignitor comprising novel combinations of standard type electronic components which are readily available, highly reliable and relatively inexpensive.

The above and other objects and advantages of this invention will be more readily apparent from a reading of the following detailed description in conjunction with the accompanying drawing, in which:

A schematic wiring diagram illustrates a control system of the type which embodies this invention.

An electronic control system shown generally at 2 controls burner motor 4 and ignitor 6. A thermostat 8 is connected to control the AC power supply to full wave bridge rectifier 10 connected to the secondary winding 11 of a step-down transformer 12. The primary winding 13 is connected to alternating current input voltage by conductors 15. The AC voltage is also connected by leads 17 and 19 to a transformer 20 in ignitor 6.

A relay switch 22, in conductor 17, as will hereinafter be described, is provided to control the "ON" and "OFF" operation of burner motor 4. Resistor 5 joins the lead to motor 4 to lead 17. Another relay switch 24 in line 17 controls the operation of the ignitor 6. For the ignitor to be energized, both switches 22 and 24 in series must be "CLOSED" while the burner motor will be energized by closing switch 22.

The control system embodying this invention comprises electronic circuit means to operate relay switches 22 and 24. Conductor 122' connects relay control 122 to relay switch 22 and conductor 124' connects relay control 124 to relay switch 24 to control the operation of the respective relay switches. The conductors are shown as broken lines for ease of illustration. The various elements of the control system are provided to selectively energize the relay controls 122 and 124. In addition, a safety timer, and reset switch 26 is provided to control relay 122 on a timed basis. Further, a relay control 128, shown in the lower portion of the schematic, is controlled by a light sensing element, such as cadmium (CAD) light detecting cell 30 disposed to detect the presence of a flame in the burner chamber. The CAD cell per se includes a resistor whose resistance varies inversely to the radiant heat of the flame detected in the furnace. Relay control 128 operates relay switch 28 in series with safety timer 26 and relay switch 38 in the direct current circuit provided to energize and deenergize relay control 122, as will be hereafter more fully described. Conductor 128', illustrated by discontinuous broken lines, connects relay control 128 to relay switch 28, adjacent reset switch 26 and to relay switch 38, shown to the left of relay control 122.

The power supply provided by the secondary winding of transformer 12 which may be 24 volts AC is connected to the bridge rectifier 10 and charges capacitor 31 to approximately 24 volts, which provides the main DC supply of about 350 milliamps for the system. Diode 32 and conductor 34 provide a second direct current power supply of about 40 milliamps for control functions when the thermostat 8 is "OPEN". At junction 35, this power supply is split between one path through resistor 36 and conductor 39 to energize flame sensing unit 30 in the furnace, and along another line 40 to energize relay control 124 in response to energization of the CAD cell circuit to control operation of the ignitor 6. From conductor 40, a current branch is also provided through resistor 43 and relay switch 38 which, when in a lowered position, contacts conductor 103. This circuit branch is completed through diode 200, diode 201, resistor 64 and diode 68 to turn "ON" transistor 112 and energize relay 124. Capacitor 41 provides means for storing a continuous energy source for energizing relay 124.

Leads 42 and 44 are connected to opposite sides of capacitor 31 and current from the capacitor follows a circuit path along lead 44 to junction 46. From junction 46, the current divides through two DC branches. The first branch passes through diode 49 and relay switch 38. When switch 38 is in its upper position, current is directed toward junction 50 where it continues through lead 52, resistor 54 and junction 55, connected to the base of transistor 112. This branch turns "ON" transistor 112 when no flame is detected by the CAD cell 30. The other DC current branch from junction 50 is through diode 58, parallel resistors 60 and relay control 122, with a return path via conductor 61, switch 63 and lead 42.

The other branch from junction 46, comprises lead 62, junction 65, then through resistor 64 to junction 66, the latter being separated from junction 55 by diode 68. From junction 65, conductor 67 provides the DC supply to the emitter of PNP transistor 76. Lead 70, from junction 66, connects the DC current supply to the base of transistor 72 through resistor 74. The collector of transistor 72 is connected by resistor 73 to the base of transistor 76 whereby the latter will be turned "ON" when transistor 72 is conducting. When transistor 76 is "ON", it serves to provide energy to silicon controlled rectifiers (SCR's) 80 and 82 via conductors 67, 78 and 79 to energize relay 122.

The control electrodes or gates of both SCR's are connected by Zener diodes 84 through parallel resistor 88 to the parallel resistors 60. A voltage divider connected from the gate to the cathode of SCR 82 is provided from junction 86 by resistors 60 on one side and resistor 87 and safety timer 26 on the other. When the SCR's are turned "ON", relay control 122 is energized to "CLOSE" oil burner relay switch 22, the circuit being completed through safety timer reset switch 63. Each SCR and Zener diode 84 with resistors 88 and 60 provide redundant switch means to energize relay control 122. The combination of PNP transistor 76 and NPN transistor 72 serve to energize the safety timer 26 via relay switch 28 and relay control 122 when the CAD cell 30 detects no flame in the furnace. Relay control 128 is energized to "OPEN" relay switch 28 and relay switch 38 to engage the lower contact 39 of conductor 103. Transistor 76 will be conducting whenever transistor 102 is "OFF".

SCR's 80 and 82 are threshold, solid state switches which redundantly turn "ON" at a predetermined gate-to-cathode voltage level, and remain latched "ON" without further triggering as long as there is a positive voltage on the anode of the SCR's. The SCR's perform three distinct functions. First by virtue of the voltage divider resistance network and Zener diodes 84, each SCR will detect the input voltage and will turn "ON" only when there is adequate voltage on capacitor 31 to safely operate the circuit. Second, the SCR's 80 and 82 will prevent the oil burner 4 and ignitor 6 from turning "ON" if a flame was detected in CAD cell 30 prior to the thermostat 8 being "CLOSED". Third, if a bimetallic resistance heating element in timer 26, as described below, is open circuited for any reason, the SCRS will prevent oil burner 4 and ignitor 6 from turning "ON" by deenergizing relay 122.

The timer 26 may include a bimetallic resistance heating element or strip such that when the bimetallic strip is heated sufficiently by current flow therethrough for a predetermined time, the strip will be deformed to "OPEN" the switch 63 and deenergize relay 122. Other types of timers may be used in this application.

The controller 2 also includes a dual functioning timing system for turning relay 24 "ON" and "OFF" in response to various operating conditions whereby the ignition is properly controlled. This type of timing system may be adapted to control either an oil or gas burner control relay.

When relay control 38 is switched by relay 128 to its lower position in contact with terminal 39, energy from the DC source will charge capacitors 98 and 198 via leads 103 and 104, diodes 100 and 200 and resistors 105 and 202. At the same time, current from conductor 62 will flow through two voltage divider networks, comprising resistors 90 and 92 and 190 and 192 having resistance values selected to program the programmable unijunction transistors (PUTS) 94 and 194 to a predetermined breakover voltage. This combination of capacitance and resistance elements will provide a predetermined time delay of about 10 seconds after which time, discharge of the voltages stored on capacitor 98 or 198 will cause transistor 102 to be turned "ON". When this happens, the current which had been flowing to the base of transistor 112 will be shunted through transistor 102, and transistor 112 will be turned "OFF", deenergizing relay control 124 and relay switch 24 will be "OPENED". A second timing function is provided by the resistance/capacitance (RC) network of 150 microfarad capacitors 98 and 198 discharging through relatively large 150,000 ohm resistors 106 and 206. This RC network provides for a second predetermined time-delay of 60–90 seconds before transistor 102 will again turn "OFF" and transistor 112 turned "ON".

When used in a gas burner control system, the capacitor and PUT may be selected to provide a first delay of about 60 seconds and a second delay of about 120 seconds. The combination of PUT 94, capacitor 98 and its charging circuit diode 100 and resistors 90, 92, 105 and 106 comprises one of two completely redundant timing delay means for controlling the operation of transistor 102 and thus, transistor 112 and relay switch 24. The other redundant control comprises PUT 194, capacitor 198, diode 200 and resistors 190, 192, 202 and 206.

The anodes of diodes 109 and 203 are connected respectively to junctions 96 and 196. These diodes are redundant components which are poled to provide for rapid discharge of voltages stored on capacitors 98 and 198 when the thermostat 8 is "OPEN", as will hereinafter be more fully described.

The photoelectric or CAD cell system comprises a radiant heat sensing CAD cell 30, with a resistance which decreases in proportion to radiant energy detected in the furnace, and a resistor 114 in series with the CAD cell to form a voltage divider network. A Zener diode 115 is connected across CAD cell 30 and resistor 114. Resistor 116 and Zener diode 118 are connected to the base of transistor 120 and the Zener will conduct at about 12 volts whereby relay control 128 is responsive to the radiant energy of the flame sensed in the burner chamber by the CAD cell 30. As previously noted, energization of relay control 128 will cause relay 28 to "OPEN" and relay 38 to switch to move to its lower position.

OPERATION

With the control system energized, the thermostat 8 "CLOSED" and no flame being detected by the CAD cell 30 in the furnace, the controller will operate to energize relay 22 and relay 24 to enable the burner 4 and ignitor 6 to start immediately.

To summarize the operation, relay 122 will be energized when the thermostat 8 is "CLOSED", when SCR's 80 and 82 are conducting along their anode-cathode paths as when relay switch 28 is "CLOSED" and when switch 63 in safety timer 26 is "CLOSED". Relay 124 will be energized by a half-wave rectified DC voltage through diode 32 via conductors 34 and 40 with transistor 112 in its conducting mode, having been turned "ON" by current from capacitor 31, conductors 44 and 62, resistor 64 and diode 68 to junction 55 connected to the base of transistor 112. The CAD cell circuit is energized by conductors 34 through resistor 36 and conductor 39. Substantially, at the same time, current flow via lead 44, diode 49, relay switch 38 and diode 58 through resistors 60 will bias "ON" SCRS 80 and 82, so long as Zener diodes 84 detect about 22 volts across the gate-to-cathode junctions of the SCR's. With the SCR's 80 and 82 both conducting, relay control 122 will be energized to "CLOSE" relay switch 22.

At that time, if no flame is detected in the furnace in approximately 15 seconds, the safety timer 26 will trip reset switch 63 to deenergize or open the circuit of relay control 122 and thus "OPEN" relay switch 22 which prevents both the oil burner motor 4 and ignition 6 from operating until the safety timer has been manually reset by "CLOSING" reset switch 63 manually.

If, however, a flame occurs in the burner within the 15 second time period and remains "ON" for a period of 10 seconds, the ignitor 6 will be deenergized by relay switch 24 being "OPENED" as follows. When the resistance of the CAD cell 30 is reduced, as with a flame being detected in the oil burner, PNP transistor 120 is turned "ON" by Zener diode 118 conducting at about 10 volts. When transistor 120 is "ON", relay control 128 is energized and switch 38 will be thrown to its lower contact 39. Conductors 103 and 104 will thus be connected to the capacitor 31 via lead 44, diode 49 and switch 38. Energy from conductor 104 will charge capacitors 98 and 198 and charging will continue up to the breakdown voltage level of PUTS 94 and 194. This will take about 10 seconds and provides means for holding the ignitor 6 "ON" for 10 seconds before it is cut "OFF" by relay 124 which will be deenergized by transistor 112 being cut "OFF" by the turn "ON" of transistor 102. As previously described, transistor 102 is turned "ON" after 10 seconds by the timed charge and discharge of capacitors 98 and 198 through PUTS 94 and 194 respectively and through resistors 106 and 206 to the base-emitter junction of transistor 102.

If the flame is extinguished following the abovedescribed 10 second time interval of flame being detected in the furnace, after a delay of approximately 90 seconds, the burner motor will restart. This 90 second delay before burner restart is provided by the relatively slow discharge of capacitors 98 and 198 through resistors 106 and 206 whereby transistor 102 is held "ON", thus shunting base-emitter current away from transistors 72 and 112 for that 90 second time duration. As a result, transistors 72 and 112 will be held "OFF" so that relay controls 122 and 124 will not be energized to "CLOSE" switches 22 and 24 until after transistor 102 is turned "OFF". Thus, the combination of the capacitors 98, 198, PUTS 94 and 194 and resistors 106 and 206 serve dual timing functions. Should the thermostat 8 be "OPENED" after the capacitors 98 and 198 have been charged, however, the capacitor voltages will be rapidly discharged through diodes 109 and 203 to recycle the system to zero capacitance voltage. Without diodes 109 and 203, if the thermostat is opened when the CAD cell senses a flame, and immediately closed again, the burner control would still remain "OFF" for the 90 second delay.

If the thermostat is "OPEN" but light is shining onto the CAD cell 30 because of firebrick flow or the like, the controller will not allow the burner 4 to start since relay 128 will be energized, opening relay switch 28. This results in a much higher resistance in the lower portion of the voltage divider flowing through resistors 60, relay control 122 and timer 26, causing lower voltage across Zener diode 84 so that SCR's 80 and 82 will not turn "ON" and relay 122 will not be energized to "CLOSE" switch 22 thereby preventing motor 4 from starting.

Another feature of the system is that the SCR's 80 and 82 will not be gated "ON" if the input line voltage falls below approximately 86 volts AC. With a voltage at or below this level, the gate circuits of the SCR's will not be biased to the breakover voltage of the SCR's.

Should the contacts of motor control relay switch 22 become stuck "CLOSED" at any time, the motor will not be allowed to pump oil continuously into the burner while the ignitor is turned "OFF", as this may result in oil flooding the furnace, posing a danger of explosion. This problem is overcome by controlling the ignitor 6 independently of the burner motor 4 so that the ignitor can only be turned "ON" when the burner motor 4 is also energized but can be turned "OFF" independently of the burner motor. To this end, relays 22 and 24 are connected in series while relay 124 is controlled independently of relay 122, thus with normal operating conditions, relay 122 is also capable of turning the ignitor 6 "OFF".

Relay 124 will be turned "ON" if any one of the following operating conditions exist:

(1) In normal operation whenever the thermostat 8 is "CLOSED" and current flows to the base of transistor 112 via leads 44 and 62, resistor 64 and diode 68 whereby the transistor 112 is turned "ON".

(2) If flame in the furnace is not detected, transistor 112 is turned "ON" by current in conductor 44, relay 38, conductor 52, and through resistor 54. If, however, flame is detected in the furnace, transistor 112 will be turned "ON" by the secondary power source via leads 34 and 40, resistor 43, relay 38, lead 103, diodes 200 and 201, resistor 64 and diode 68.

Under all the above conditions, the ignitor relay 124 will be energized and the ignitor 6 will be turned "ON". If relay contacts 22 are stuck "CLOSED", it is important to have the ignitor relay 12 energized so that the oil being pumped into the furnace will be ignited to avoid excessive build-up of the combustible fuel with the resultant danger of flooding and/or explosion.

This must occur even though the contacts 22 may be stuck "CLOSED", with the thermostat 6 "OPEN" or "CLOSED" and the safety timer 26 "OPEN" or "CLOSED". Either of the two following conditions will occur:

(1) When CAD cell 30 detects flame, the ignitor 6 will go from "ON" to "OFF" in 10 seconds because of the capacitor 98, PUT 94 and resistor 106 which will turn "ON" transistor 102, turn "OFF" transistor 112 and relay 124 to deenergize the ignitor.

(2) With no flame being sensed by the CAD cell 30, the ignitor 6 goes "ON" and then "OFF" in 10 seconds after the flame is sensed.

Having thus described this invention, what is claimed is:

1. Solid state control for a fluid fuel burner having an oil burner motor and ignitor with a first electrically operated relay control element to energize the motor and a second relay control element to energize the ignitor, said control system comprising a thermostat, a first direct current power supply means in circuit with and controlled by said thermostat, a second direct current supply means independent of said thermostat, at least one silicon controlled rectifier (SCR) switching component for controlling the direct current flow to energize said first relay control at a predetermined threshold voltage and to latch "ON" despite variation in the direct current flow through the SCR, a first pair of transistors connected so that the turn "ON" of one of the pair will turn "OFF" the second of said pair, the second of said transistor being connected to control the second direct current supply through the control element of said second relay, a capacitor discharge circuit, including a capacitor adapted to be charged by the first direct current supply and a programmable unijunction transistor (PUT) connected to breakdown and conduct when the capacitor is charged to a predetermined voltage level, the second transistor of said pair being connected in circuit with the breakdown current of said PUT and a resistor to delay the discharge of said capacitor through said PUT whereby said capacitor and PUT provide a dual timing function which controls the operation of the second relay control element in response to both the charging and discharging of said capacitor.

2. Solid state control system for a fluid fuel burner, as set forth in claim 1, in which a diode is connected from said capacitor and is poled to discharge the voltage thereon when said thermostat is "OPEN" to reset the dual timing function of the capacitor discharge circuit when the thermostat is opened.

3. Solid state control system for a fluid fuel burner, as set forth in claim 2, in which said system includes a photoelectric flame detector cell with a third relay control element connected to be energized by a third transistor, a switch in said control system responsive to said third control element to connect said capacitor to the primary energy source when the photoelectric cell detects flame in the furnace of the oil burner.

4. In a solid state controller for a fluid fuel burner, a timing control system comprising a direct current energy source, a switch means connecting said direct current energy source to a capacitor to be charged by said direct current source, a programmable unijunction transistor (PUT) having an anode, cathode and control electrode connected across the anode and cathode of said PUT, said control electrode being connected to a voltage divider resistance network selected to program the PUT to breakover at a predetermined voltage level, a resistor connected to the cathode of said PUT and selected to provide a time-delayed discharge of said capacitor through the PUT and said resistor, a transistor connected to be rendered conductive by the discharge of said capacitor through said PUT and to be energized by said direct current energy source independent of said switch means, the time for charging said capacitor to the breakover voltage of said PUT provides a first timing function, a second timing function being provided by the delayed discharge of the capacitor through the PUT and said resistor to render said transistor conductive, a relay of said burner being selectively energized and deenergized by said transistor whereby, in the dual timing sequence provided by said system, said relay operates independently of said switch means.

5. In a solid state controller for a fluid fuel burner having an oil burner motor and ignitor with an electrically operated relay control means to energize the motor and the ignitor, said control system comprises a thermostat, a first direct current power supply in circuit with said thermostat, a second direct current supply independent of said thermostat, at least one silicon controlled rectifier (SCR) switching component for controlling the direct current flow to energize the relay control means when there is sufficient voltage to safely operate the solid state control system.

6. In a solid state controller for a fluid fuel burner, as set forth in claim 5, further comprising a flame detector including a relay control element for controlling a relay switch in circuit with said SCR so that such SCR deenergizes said relay control means when said thermostat is "CLOSED" and a flame is sensed by said flame detector.

7. In a solid state controller for a fluid fuel burner, as set forth in claim 6, further comprising a time operated switch including a bimetallic resistance strip which deflects when current flows through said resistance for a predetermined time to cause said strip to "OPEN" said switch, said strip being connected in circuit with the output of the SCR to deenergize said relay control means when direct current in the circuit does not flow through the timer switch due to an open circuit in the bimetallic strip.

* * * * *